US006929533B2

(12) United States Patent
Chang

(10) Patent No.: US 6,929,533 B2
(45) Date of Patent: Aug. 16, 2005

(54) METHODS FOR ENHANCING WITHIN-WAFER CMP UNIFORMITY

(75) Inventor: Weng Chang, Hsin-Chu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 10/684,288

(22) Filed: Oct. 8, 2003

(65) Prior Publication Data

US 2005/0079801 A1 Apr. 14, 2005

(51) Int. Cl.[7] ..... B24B 1/00
(52) U.S. Cl. ..... 451/37; 451/60; 451/57; 451/446
(58) Field of Search ..... 451/37, 56, 57, 451/60, 443, 446

(56) References Cited

U.S. PATENT DOCUMENTS 5,679,063 A * 10/1997 Kimura et al. ..... 451/287
5,997,392 A * 12/1999 Chamberlin et al. ..... 451/446
6,283,840 B1 * 9/2001 Huey ..... 451/288
6,284,092 B1 * 9/2001 Manfredi ..... 156/345.12
6,398,627 B1 * 6/2002 Chiou et al. ..... 451/72
6,429,131 B2 * 8/2002 Lin et al. ..... 438/691
6,506,098 B1 * 1/2003 Ho et al. ..... 451/36
6,733,373 B1 * 5/2004 Yang et al. ..... 451/296
2001/0000774 A1 * 5/2001 Volodarsky ..... 451/307
2002/0022440 A1 * 2/2002 Kunugi ..... 451/60
2002/0039877 A1 * 4/2002 Svirchevski et al. ..... 451/56
2002/0164936 A1 * 11/2002 Smith et al. ..... 451/307
2003/0199229 A1 * 10/2003 Vereen et al. ..... 451/36
2004/0084042 A1 * 5/2004 McAulay et al. ..... 125/21

* cited by examiner

*Primary Examiner*—David B. Thomas
(74) *Attorney, Agent, or Firm*—Tung & Associates

(57) ABSTRACT

A method for enhancing uniformity in the polishing profile of a substrate during chemical mechanical polishing. According to a first embodiment, the method is adapted for a rotary-type chemical mechanical polisher and includes dispensing the polishing slurry onto the rotating polishing pad of the CMP apparatus in a polishing area on the polishing pad that contacts the entire surface area of the substrate. This facilitates substantially equal polishing rates and a substantially uniform polishing profile from the center to the edge regions on the surface of the substrate. According to a second embodiment, the method of the present invention is adapted for a linear-type chemical mechanical polisher and includes increasing the number of nozzles that dispense the slurry onto the polishing pad across the diameter or width of the substrate.

20 Claims, 2 Drawing Sheets

METHODS FOR ENHANCING WITHIN-WAFER CMP UNIFORMITY

FIELD OF THE INVENTION

The present invention relates to chemical mechanical polishing apparatus used in the polishing of semiconductor wafers. More particularly, the present invention relates to methods for enhancing uniformity in the polishing profile of substrates during chemical mechanical polishing (CMP).

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shadow trench isolation (STI) layer, inter-layer dielectric (ILD) or on an inter-metal dielectric (IMD) layer, which are frequently used in memory devices. The planarization process is important since it enables the subsequent use of a high-resolution lithographic process to fabricate the next-level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing, or CMP. The process has been widely used on ILD or IMD layers in fabricating modern semiconductor devices. A CMP process is performed by using a rotating platen in combination with a pneumatically-actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen, with a resilient layer as an outer layer of the pad. The layers are typically made of a polymeric material such as polyurethane and may include a filler for controlling the dimensional stability of the layers. A polishing pad is typically made several times the diameter of a wafer in a conventional rotary CMP, while the wafer is kept off-center on the pad in order to prevent polishing of a non-planar surface onto the wafer. The wafer itself is also rotated during the polishing process to prevent polishing of a tapered profile onto the wafer surface. The axis of rotation of the wafer and the axis of rotation of the pad are deliberately not collinear; however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 A and about 10,000 A. The uniformity requirement for ILD or IMD polishing is very stringent since non-uniform dielectric films lead to poor lithography and resulting window-etching or plug-formation difficulties. The CMP process has also been applied to polishing metals, for instance, in tungsten plug formation and in embedded structures. A metal polishing process involves a polishing chemistry that is significantly different than that required for oxide polishing.

Important components used in CMP processes include an automated rotating polishing platen and a wafer holder, which both exert a pressure on the wafer and rotate the wafer independently of the platen. The polishing or removal of surface layers is accomplished by a polishing slurry consisting mainly of colloidal silica suspended in deionixed water or KOH solution. The slurry is frequently fed by an automatic slurry feeding system in order to ensure uniform wetting of the polishing pad and proper delivery and recovery of the slurry. For a high-volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in controlling polishing rates at different locations on a wafer surface. Since the polishing rate applied to a wafer surface is generally proportional to the relative rotational velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated for by rotating the wafer surface during the polishing process such that a uniform average polishing rate can be obtained, the wafer surface, in general, is exposed to a variable polishing rate during the CMP process.

Referring to FIG. 1A, a conventional rotary-type CMP apparatus 50 includes a wafer carrier 52, a polishing pad 56, and a slurry delivery arm 54 positioned over the polishing pad 56. The wafer carrier 52 is mounted on the bottom end of a vertical shaft 53 which rotates and presses a semiconductor wafer 66, mounted on the bottom surface of the wafer carrier 52, against the upper surface 60 of the polishing pad 56 as the polishing pad 56 is rotated. The slurry delivery arm 54 is equipped with slurry dispensing nozzles 62 which are used for dispensing a slurry solution 64 onto the upper surface 60 of the rotating polishing pad 56. As the wafer carrier 52 rotates the wafer 66 against the upper surface 60 of the polishing pad 56, the polishing slurry 64 dispensed thereon by the slurry delivery arm 54 travels with the rotating polishing pad 56 until the polishing slurry 64 moves between the wafer 66 and the polishing pad 56. Accordingly, the polishing slurry 64 substantially polishes or planarizes the surface of the wafer 66.

Recently, a chemical mechanical polishing method has been developed in which the polishing pad is not moved in a rotational manner but instead, in a linear manner. It is therefore named as a linear chemical mechanical polishing process, in which a polishing pad is moved in a linear manner in relation to a rotating wafer surface. The linear polishing method affords a more uniform polishing rate across a wafer surface throughout a planarization process for the removal of a film layer from the surface of a wafer. One added advantage of the linear CMP system is the simpler construction of the apparatus, and this not only reduces the cost of the apparatus but also reduces the floor space required in a clean room environment.

A typical linear CMP apparatus 10 is shown in FIG. 1B. The linear CMP apparatus 10 is utilized for polishing a semiconductor wafer 24, i.e., a silicon wafer in removing a film layer of either an insulating material or a conductive material from the wafer surface. For instance, the film layer to be removed may include insulating materials such as silicon oxide, silicon nitrite or spin-on-glass material or a metal layer such as aluminum, copper or tungsten. Various other materials such as metal alloys or semi-conducting materials such as polysilicon may also be removed.

As shown in FIG. 1B, the wafer 24 is mounted on a rotating wafer holder 18, which rotates at a predetermined speed. The major difference between the conventional linear CMP apparatus 10 and the predecessor rotary CMP apparatus 50 (FIG. 1A) is that a continuous, or endless, polishing belt 12 is utilized instead of a rotating polishing pad. The polishing belt 12 moves in a linear, rather than rotational, manner in respect to the rotational surface of the wafer 24. The linear polishing belt 12 is mounted in a continuous manner over rollers 14 driven by a motor (not shown) at a predetermined rotational speed. The rotational motion of the rollers 14 is transformed into a linear motion 26 in respect to the surface of the wafer 24. In the conventional linear CMP apparatus 10, one or more polishing pads 30 are adhesively joined to the continuous polishing belt 12 on its outer surface that faces the wafer 24. A polishing assembly 38 is thus formed by the continuous polishing belt 12 and the polishing pad or pads 30 glued or otherwise attached thereto.

During the CMP process, the wafer holder 18 is normally operated in a rotational mode such that a uniform polishing on the wafer 24 can be achieved. To further improve the uniformity of linear polishing, a support housing 32 is further utilized to provide support to a support platen (not shown) during a polishing process. The support platen provides a supporting platform for the underside of the continuous polishing belt 12 to ensure that the polishing pad 30 makes sufficient contact with the surface of the wafer 24 in order to achieve more uniform material removal from the surface layer of the wafer 24. Typically, the wafer holder 18 is pressed downwardly against the continuous polishing belt 12 and the polishing pad 30 at a predetermined force such that a suitable polishing rate on the surface of the wafer 24 can be obtained. Air pressure is typically further used to push the support platen upwardly against the polishing belt 12 which, in turn, pushes the polishing pad or pads 30 against the wafer 24. A desirable polishing rate on the wafer surface can therefore by obtained by suitably adjusting the downward force on the wafer carrier 28, the upward air pressure against the support platen, and the linear speed 26 of the polishing pad 30. A slurry dispenser 20, having multiple, typically eleven, slurry dispensing nozzles 34, as shown in FIG. 1C, is further utilized to dispense a slurry solution 36 through the respective slurry dispensing nozzles 34 onto the polishing pad or pads 30. As further shown in FIG. 1C, the slurry dispensing nozzles 34 are typically disposed at a distance "D" of 30 mm.

For Cu CMP applications involving low-K IMD (intermetal dielectric) for planarization, interconnect and gap-fill at 0.13 $\mu$m and smaller device generations, both the rotary CMP apparatus and the linear CMP apparatus typically utilize a polishing slurry that contains little or no abrasive in order to prevent or minimize damage to the low-k IMDs. For that type of slurry, the within-wafer slurry distribution is of utmost importance in achieving optimal polishing uniformity among all regions on the wafer surface, particularly with regard to 300 mm-diameter wafers.

Referring again to FIG. 1A, the dispensing nozzles 62 of the slurry dispensing arm 54 of the conventional rotary-type CMP apparatus 50 typically dispense the polishing slurry 64, having little or no abrasive, onto the rotating polishing pad 56 in such a location that the polishing slurry 64 initially contacts the center region of the wafer 66 as the slurry 64 moves beneath the rotating wafer 66. This causes higher polishing rates at the center relative to the edge regions of the wafer 66, resulting in an uneven polishing profile across the surface of the wafer 66.

Referring again to FIG. 1B, the slurry dispenser 20 of the conventional linear CMP apparatus 10 typically includes about eleven of the slurry dispensing nozzles 34 that are spaced along the length of the slurry dispenser 20. Accordingly, higher polishing rates are achieved on those regions of the wafer 24 that initially contact the polishing slurry 36 on the polishing pads 30, relative to the other regions on the surface of the wafer 24. This results in an uneven polishing profile across the surface of the wafer 24. Accordingly, a new and improved method is needed for dispensing a polishing slurry on a polishing pad in such a position or positions on the polishing pad that polishing rates, and thus, polishing profiles, on the wafer surface are more uniform.

An object of the present invention is to provide a new and improved method for dispensing a polishing slurry onto a polishing pad during a chemical mechanical polishing process.

Another object of the present invention is to provide a new and improved method for enhancing the polishing rates and polishing profile on the surface of a wafer.

Still another object of the present invention is to provide a method for enhancing the polishing rates and profile on the surface of a wafer using a rotary-type chemical mechanical polisher.

Yet another object of the present invention is to provide a method for enhancing the polishing rates and profile on the surface of a wafer using a linear-type chemical mechanical polisher.

A still further object of the present invention is to provide a method for enhancing the within-wafer distribution of slurry applied to a wafer during a chemical mechanical polishing process using a rotary-type polisher or a linear-type polisher.

Yet another object of the present invention is to provide a method for providing a substantially uniform polishing profile on a wafer by chemical mechanical polishing.

Still another object of the present invention is to provide a chemical mechanical polishing method which is well-suited to achieving a substantially uniform polishing profile on a wafer using a polishing slurry having little or no abrasive.

SUMMARY OF THE INVENTION

In accordance with these and other objects and advantages, the present invention is generally directed to new and improved methods for enhancing uniformity in the polishing profile of a substrate during chemical mechanical polishing, particularly for CMP applications in which a polishing slurry having little or no abrasive is used in low-K IMD copper interconnect applications. According to a first embodiment, the method is adapted for a rotary-type chemical mechanical polisher and includes dispensing the polishing slurry onto the rotating polishing pad of the CMP apparatus in a polishing area on the polishing pad that contacts the entire surface area of the substrate. This facilitates substantially equal polishing rates and a substantially uniform polishing profile from the center to the edge regions on the surface of the substrate. According to a second embodiment, the method of the present invention is adapted for a linear-type chemical mechanical polisher and includes increasing the number of nozzles that dispense the slurry onto the polishing pad across the diameter or width of the substrate.

BRIEF DESCRIPTION OF THE DRAWINGS

The invention will now be described, by way of example, with reference to the accompanying drawings, in which.

DESCRIPTION OF THE PREFERRED EMBODIMENTS

The present invention has particularly beneficial utility in the polishing or planarization of semiconductor wafer substrates used in the fabrication of semiconductor integrated circuits. However, the invention is not so limited in application, and while references may be made to such semiconductor wafer substrates, the present invention may be more generally applicable to polishing or planarization of substrates in a variety of mechanical and industrial applications.

Figure 1A:
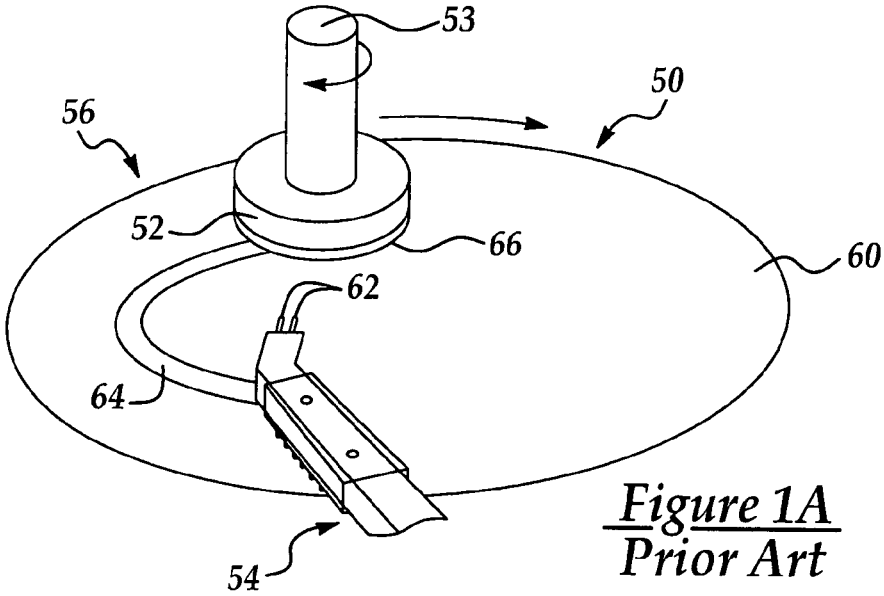
Figure 1A Prior Art
FIG. 1A is a perspective view of a typical conventional rotary-type chemical mechanical polishing apparatus.
Figure 1B:
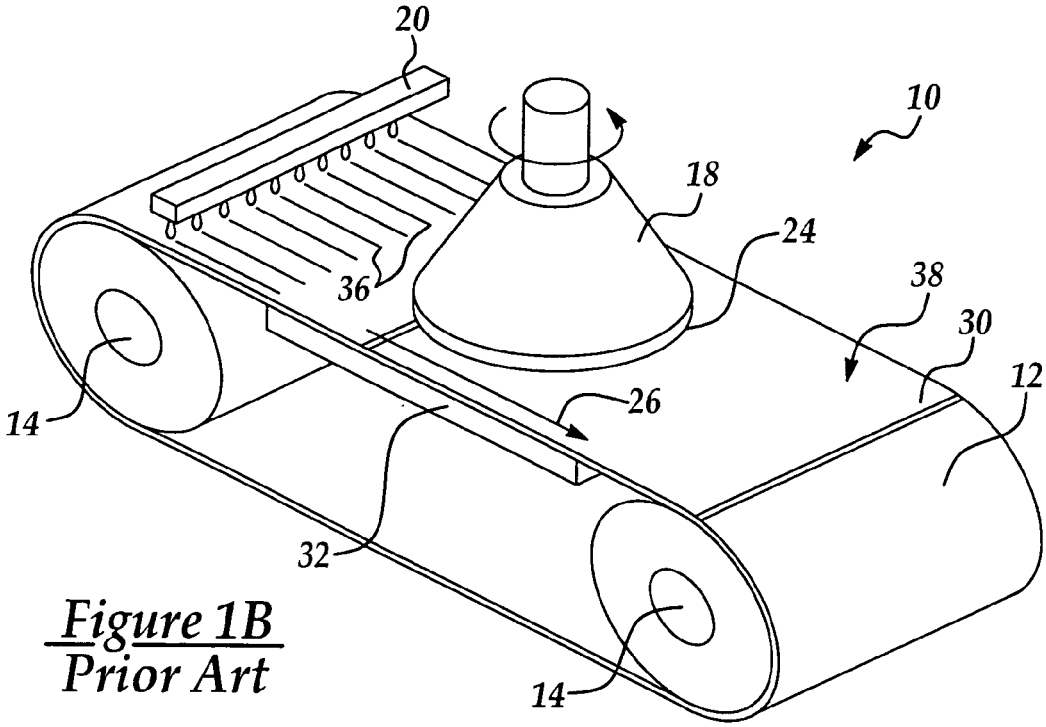
Figure 1B Prior Art
FIG. 1B is a perspective view of a typical conventional linear-type chemical mechanical polishing apparatus.
Figure 1C:
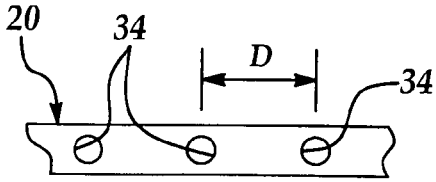
Figure 1C Prior Art
FIG. 1C is a bottom view, partially in section, of a slurry dispenser element of the conventional CMP apparatus of FIG. 1B.
Figure 2:
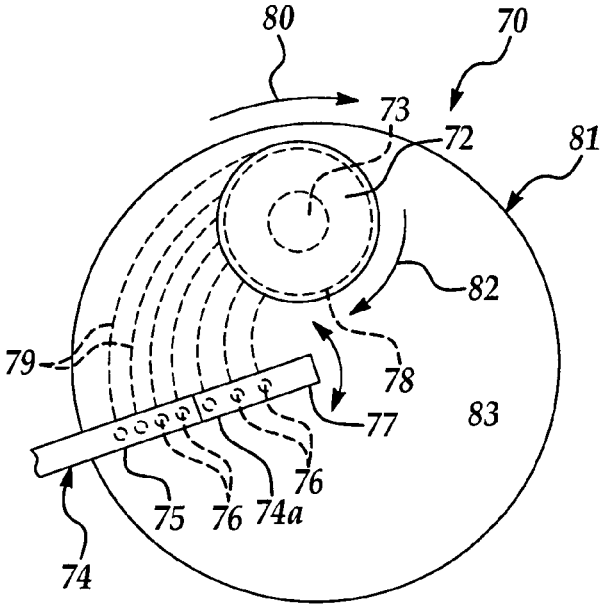
FIG. 2 is a top view of a rotary-type chemical mechanical polishing apparatus in implementation of one embodiment of the present invention.
Figure 3:
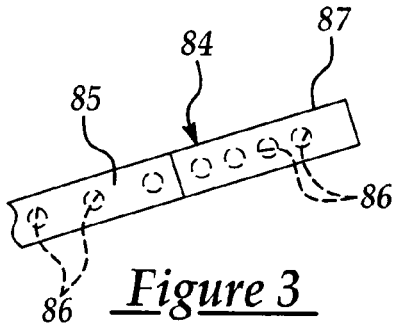
FIG. 3 is a top view, partially in section, of a slurry bar element of a rotary-type chemical mechanical polishing apparatus in implementation of another embodiment of the present invention.

Referring initially to FIGS. 2 and 3, a rotary CMP apparatus 70 in implementation of the present invention includes a circular polishing pad 81. A wafer carrier 72, typically mounted on the bottom end of a vertical shaft 73, is disposed above the upper surface 83 of the polishing pad 81, in conventional fashion. In use, a wafer 78 is mounted on the bottom surface of the wafer carrier 72, typically in conventional fashion, and the wafer carrier 72 rotates the wafer 78 against the upper surface of the polishing pad 81, as indicated by the arrow 82, as the polishing pad 81 rotates as indicated by the arrow 80, to polish the surface of the wafer 78, as hereinafter further described. The apparatus 70 further includes an elongated slurry dispensing bar 74 having a proximal segment 75 and a distal segment 77 that extends from the proximal segment 75 at a center point 74*a*. The center point 74*a* is disposed directly above a position on the upper surface 83 of the rotating polishing pad 81 which passes beneath the center of the wafer 78. The proximal segment 75 of the slurry dispensing bar 74 is provided in fluid communication with a supply (not shown) of polishing slurry 79. The proximal segment 75 and the distal segment 77 each is provided with multiple slurry dispensing nozzles 76 in the bottom thereof for dispensing a polishing slurry solution 79 onto the upper surface 83 of the polishing pad 81 as the polishing pad 81 is rotated. Typically, the proximal segment 75 has a larger number of the slurry dispensing nozzles 76 than does the distal segment 77. However, in another embodiment of the slurry dispensing bar 84, shown in FIG. 3, the distal segment 87 includes a larger number of slurry dispensing nozzles 86 than does the proximal segment 85.

In application, the rotary CMP apparatus 70 is typically used to polish a wafer 78 in low-k IMD, local copper interconnection applications for fabrication of device features on the order of 0.13 $\mu$M and smaller. This type of application utilizes a polishing slurry 79 containing little (typically less than about 1% by weight) or no abrasive particles. While the wafer 78 typically has a diameter of 300 mm, it is understood that the present invention may be adapted for wafers having other diameters or widths. The wafer 78 is rotated against the upper surface 83 of the polishing pad 81, as indicated by the arrow 82, as the wafer carrier 72 presses the wafer 78 against the polishing pad 81 and the polishing pad 81 is rotated as indicated by the arrow 80. Simultaneously, the polishing slurry 79 is dispensed from the slurry bar 74, through the slurry dispensing nozzles 76 of both the proximal segment 75 and the distal segment 77, and onto the upper surface 83 of the rotating polishing pad 81. The slurry dispensing bar 74 may be swept in a side-to-side motion as indicated by the double-headed arrow. Because it is dispensed onto the polishing pad 81 in multiple, adjacent slurry lines across a polishing area on the upper surface 83 of the polishing pad 81 that encompasses the diameter of the wafer 78, the polishing slurry 79 travels with the rotating polishing pad 81 and then contacts the surface of the wafer 78 across the entire diameter thereof as the polishing slurry 79 is moved by the polishing pad 81 beneath the rotating wafer 78. Consequently, the within-wafer distribution of the polishing slurry 79 is substantially uniform and the polishing rate across the entire surface area on the wafer 78 is substantially uniform, resulting in a substantially uniform polishing profile through the entire polished surface of the wafer 78.

Figure 4:
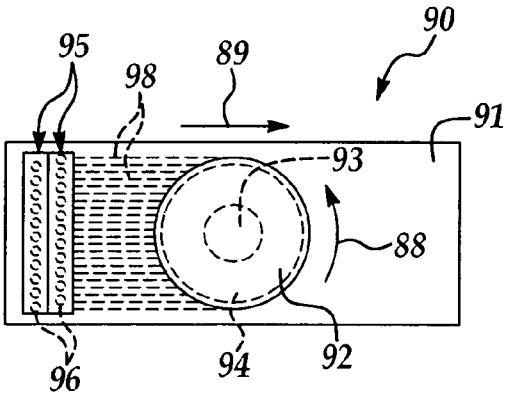
FIG. 4 is a top view of a linear-type chemical mechanical polishing apparatus in implementation of another embodiment of the present invention.
Figure 5:
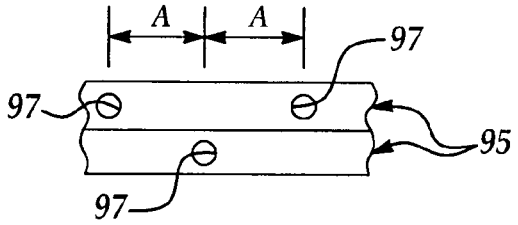
FIG. 5 is a bottom view, in section, of a pair of slurry bars used in implementation of the present invention as shown in FIG. 4.
Figure 6:
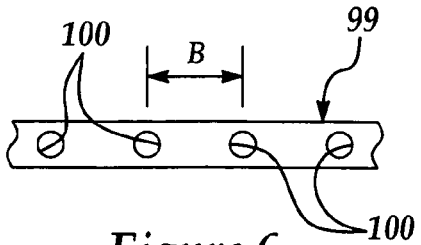
FIG. 6 is a bottom view of a single slurry bar suitable for implementation of the present invention.

Referring next to FIGS. 4–6, a linear CMP apparatus 90 in implementation of the present invention includes an endless polishing belt 91, typically fitted with one or multiple olishing pads (not shown) and driven by a roller or rollers (not shown), in conventional fashion. A wafer holder 92 is mounted above the polishing belt 91, on the bottom end of a shaft 93, in conventional fashion. In use, a wafer 94 to be polished is mounted on the bottom surface of the wafer holder 92, typically in conventional fashion, and the wafer holder 92 rotates the wafer 94 as indicated by the arrow 88 as the polishing belt 91 is driven linearly by the rollers (not shown) as indicated by the arrow 89. A slurry delivery conduit includes a pair of adjacent slurry dispensing bars 95 disposed above the polishing belt 91, perpendicular to the longitudinal axis thereof, at the "upstream" end of the polishing belt 91. Each of the slurry dispensing bars 95 is provided in fluid communication with a supply (not shown) of polishing slurry 98. Each of the slurry dispensing bars 95 is provided with multiple, typically eleven, slurry dispensing nozzles 96, each having a nozzle opening 97 in the bottom of the corresponding slurry dispensing bar 95, for dispensing the polishing slurry 98 onto the linearly-traveling polishing belt 91.

As shown in FIG. 5, the nozzle openings 97 in each slurry bar 95 are offset or staggered with respect to the nozzle openings 97 in the adjacent slurry bar 95. The distance "A" between each nozzle opening 97 in one of the slurry dispensing bars 95 and the next nozzle opening 97 in the adjacent slurry dispensing bar 95 is less than about 30 mm. In a preferred embodiment, the slurry dispensing bars 95 have a total of twenty-two nozzle openings 97 and the spacing "A" between adjacent nozzle openings 97 is about 14.28 mm apart. However, it is understood that the slurry dispensing bars 95 may have a greater or lesser number of the nozzle openings 97, with the spacing "A" between adjacent nozzle openings 97 less than about 30 mm. Each of the nozzle openings 97 has a diameter or width of typically about 2–3 mm. The nozzle openings 97 in the adjacent slurry dispensing bars 95 span an area above the polishing belt 91 that approximates the diameter of the wafer 94.

In an alternative embodiment, shown in FIG. 6, a single slurry dispensing bar 99 replaces the two adjacent slurry dispensing bars 95 shown in FIGS. 4 and 5. Adjacent nozzle openings 100 in the slurry dispensing bar 99 are disposed at a spacing "B" of less than about 30 mm with respect to each other.

In application, the linear CMP apparatus 90 is typically used to polish a wafer 94 in low-k IMD, local copper interconnection applications for fabrication of device features on the order of 0.13 $\mu$M and smaller and utilizes a polishing slurry 98 containing little (typically less than about 1% by weight) or no abrasive particles. While the wafer 94 typically has a diameter of 300 mm, it is understood that the present invention may be adapted for wafers having other diameters or widths. The wafer holder 92 rotates the wafer 94 against the polishing belt 91, as indicated by the arrow 88, as the wafer holder 92 presses the wafer 94 against the polishing belt 91 and the polishing belt 91 is driven in a linear direction as indicated by the arrow 89. Simultaneously, the polishing slurry 98 is dispensed from the adjacent slurry dispensing bars 95, through the nozzle openings 97 of the respective nozzles 96, and onto the moving polishing belt 91. Because it is dispensed onto the polishing belt 91 in adjacent slurry lines across a polishing area on the polishing belt 91 that substantially encompasses the diameter of the wafer 94, the polishing slurry 98 travels with the polishing belt 91 and then contacts the surface of the wafer 94 across the entire diameter thereof as the polishing slurry 98 is moved by the polishing belt 91 beneath the rotating wafer 94. Consequently, the within-wafer distribution of the polishing slurry 98 is substantially uniform and the polishing rate across the entire surface area on the wafer 94 is substantially uniform, resulting in a substantially uniform polishing profile through the entire polished surface of the wafer 94.

While the preferred embodiments of the invention have been described above, it will be recognized and understood that various modifications can be made in the invention and the appended claims are intended to cover all such modifications which may fall within the spirit and scope of the invention.

What is claimed is:

1. A slurry distribution system for enhancing removal rate uniformity in a linear CMP apparatus, comprising:

a slurry delivery conduit for receiving a slurry; and a plurality of nozzles comprising a first set of spaced-apart nozzles provided in fluid communication with said slurry delivery conduit and a second set of spaced-apart nozzles provided in fluid communication with said slurry delivery conduit, said second set of nozzles disposed in alternating and staggered relationship with respect to said first set of nozzles.

2. The system of claim 1 wherein adjacent ones of said plurality of nozzles are disposed at a distance of less than about 30 mm with respect to each other.

3. The system of claim 1 wherein said slurry delivery conduit comprises a first slurry delivery bar and a second slurry delivery bar adjacent to said first slurry delivery bar, and wherein said first set of nozzles is provided in said first slurry delivery bar and said second set of nozzles is provided in said second slurry delivery bar.

4. The system of claim 3 wherein adjacent ones of said plurality of nozzles are disposed at a distance of less than about 30 mm with respect to each other.

5. The system of claim 2 wherein said adjacent ones of said plurality of nozzles are disposed at a distance of about 14.28 mm with respect to each other.

6. The system of claim 5 wherein said slurry delivery conduit comprises a first slurry delivery bar and a second slurry delivery bar adjacent to said first slurry delivery bar, and wherein said first set of nozzles is provided in said first slurry delivery bar and said second set of nozzles is provided in said second slurry delivery bar.

7. The system of claim 1 wherein each of said plurality of nozzles has a nozzle opening of about 2–3 mm in width.

8. The system of claim 7 wherein adjacent ones of said plurality of nozzles are disposed at a distance of less than about 30 mm with respect to each other.

9. The system of claim 7 wherein said slurry delivery conduit comprises a first slurry delivery bar and a second slurry delivery bar adjacent to said first slurry delivery bar, and wherein said first set of nozzles is provided in said first slurry delivery bar and said second set of nozzles is provided in said second slurry delivery bar.

10. The system of claim 9 wherein adjacent ones of said plurality of nozzles are disposed at a distance of less than about 30 mm with respect to each other.

11. The system of claim 8 wherein said adjacent ones of said plurality of nozzles are disposed at a distance of about 14.28 mm with respect to each other.

12. The system of claim 11 wherein said slurry delivery conduit comprises a first slurry delivery bar and a second slurry delivery bar adjacent to said first slurry delivery bar, and wherein said first set of nozzles is provided in said first slurry delivery bar and said second set of nozzles is provided in said second slurry delivery bar.

13. A slurry distribution system for enhancing uniformity in the removal of material from a substrate in a rotary CMP apparatus, comprising:

a slurry dispensing bar for receiving a slurry, said slurry dispensing bar having a proximal segment, a distal segment, and a center point corresponding to a center of the substrate when the substrate is mounted on the apparatus;

a proximal set of slurry dispensing nozzles provided in fluid communication with said proximal segment for dispensing a first quantity of the slurry onto the substrate;

a distal set of slurry dispensing nozzles provided in fluid communication with said distal segment for dispensing a second quantity of the slurry unequal to said first quantity onto the substrate; and wherein said proximal set of slurry dispensing nozzles and said distal set of slurry dispensing nozzles are unequal in slurry-dispensing area.

14. The system of claim 13 wherein said slurry dispensing nozzles of said proximal set and said slurry dispensing nozzles of said distal set are unequal in number.

15. The system of claim 13 wherein said slurry dispensing nozzles of said proximal set are unequal in size to said slurry dispensing nozzles of said distal set.

16. The system of claim 13 wherein said slurry dispensing nozzles of said proximal set and said slurry dispensing nozzles of said distal set are unequal in size and number.

17. A method of polishing a substrate, comprising the steps of:

providing a polishing surface;

imparting movement to said polishing surface;

providing a slurry dispensing bar having a first set of slurry dispensing nozzles and a second set of slurry dispensing nozzles over said polishing surface, said first set and said second set of slurry dispensing nozzles extending over a width of the substrate;

dispensing onto said polishing surface a first quantity of polishing slurry through said first set of slurry dispensing nozzles and a second quantity of polishing slurry unequal to said first quantity of polishing slurry through said second set of slurry dispensing nozzles; and pressing the substrate against said polishing surface at said polishing area.

18. The method of claim 17 wherein said polishing slurry comprises less than about 1% by weight of abrasive particles.

19. The method of claim 17 wherein said polishing surface comprises a circular polishing pad and wherein said first quantity of polishing slurry is higher than said second quantity of polishing slurry.

20. A method of polishing a substrate, comprising the steps of:

providing a polishing surface;

imparting movement to said polishing surface;

providing a slurry dispensing bar having a first set of slurry dispensing nozzles and a second set of slurry dispensing nozzles over said polishing surface, said first set and said second set of slurry dispensing nozzles extending over a width of the substrate;

dispensing onto said polishing surface a first quantity of polishing slurry through said first set of slurry dispensing nozzles and a second quantity of polishing slurry through said second set of slurry dispensing nozzles;

pressing the substrate against said polishing surface at said polishing area; and wherein said first set of slurry dispensing nozzles and said second set of slurry dispensing nozzles are disposed in staggered relationship with respect to each other.

* * * * *